US005176186A

United States Patent [19]

Bousfield et al.

[11] Patent Number: 5,176,186

[45] Date of Patent: Jan. 5, 1993

[54] MAGNETICALLY OPERATED JACQUARD HEALD ROD SELECTOR

[75] Inventors: Alan Bousfield, Gateshead; Gawayne Mahboubian-Jones, Durham, both of United Kingdom

[73] Assignee: Bonas Machine Company Limited, Gateshead, England

[21] Appl. No.: 721,565

[22] PCT Filed: Feb. 7, 1990

[86] PCT No.: PCT/GB90/00185

§ 371 Date: Jul. 29, 1991

§ 102(e) Date: Jul. 29, 1991

[87] PCT Pub. No.: WO90/09472

PCT Pub. Date: Aug. 23, 1990

[30] Foreign Application Priority Data

Feb. 9, 1989 [GB] United Kingdom ..... 8902849

[51] Int. Cl.[5] ..... D03C 3/20

[52] U.S. Cl. ..... 139/455; 139/65

[58] Field of Search ..... 139/455, 65

[56] References Cited

U.S. PATENT DOCUMENTS 4,593,723 6/1986 Griffith ..... 139/455 X
4,667,704 5/1987 Griffith ..... 139/455 X
4,936,357 6/1990 Keim et al. ..... 139/455

FOREIGN PATENT DOCUMENTS 0119787 6/1984 European Pat. Off. .
0188074 12/1986 European Pat. Off. .
0287921 10/1988 European Pat. Off. .
63-264942 11/1988 Japan ..... 139/455
2047755 7/1980 United Kingdom .

*Primary Examiner*—Andrew M. Falik
*Attorney, Agent, or Firm*—Dann, Dorfman, Herrell and Skillman

[57] ABSTRACT

A heald control system including a heald rod which is reciprocated along its longitudinal axis, the heald rod having a resiliently deflectable body portion formed from a magnetically attractable material. A retention latch formation on the body portion, during reciprocation of the heald rod, is moved along a path of travel between first and second limits of reciprocal movement. The path has a first zone of movement wherein the body portion normally travels in an undeflected position, and a second zone of movement wherein the body portion travels in a deflected position. A permanent magnet means is operable as the body portion enters the second zone to cause the body portion to move from the undeflected position to the deflected position. A fixed latch is located to one side of the first zone of the path of travel to engage the latch formation on the body portion only when the body portion is in its deflected position as it travels in the first zone. An electromagnet is located adjacent said path of travel so that the body portion is located in the vicinity of the electromagnet when in its deflected position, the electromagnet when energized holding the body portion in the deflected position as the latch formation moves from the second zone and into the first zone of travel, thereby causing the latch formation to engage the fixed latch.

10 Claims, 7 Drawing Sheets

MAGNETICALLY OPERATED JACQUARD HEALD ROD SELECTOR

FIELD OF THE INVENTION

The present invention relates to a heald rod retention system for use with an electronic jacquard system.

BACKGROUND OF THE INVENTION

In our European patents 0119787 and 0188074 (U.S. Pat. Nos. 4,593,723 and 4,667,704), we describe heald rod retention devices which act upon deflectable heald rods. The heald rod retention devices include electromagnets which on activation act to deflect a heald rod and cause it to engage with a latch for retention.

SUMMARY OF THE INVENTION

It is a general aim of the present invention to provide a similar heald rod retention device which utilises non-mechanical means for deflecting the heald rod and which utilises the electromagnet to retain a deflected heald rod in its deflected position and which does not rely upon a mechanical operation for deflecting the heald rod to its deflected position for retention by the electromagnet.

In accordance with the present invention deflection of the heald rod to its deflected position is caused by the presence of a permanent magnetic field. The permanent magnetic field may be created by permanent magnets arranged on the body of the heald retention device and/or the heald rod and may be arranged to cause deflection by reason of magnetic attraction or magnetic repulsion.

According to one aspect of the present invention there is provided a heald control system including a heald rod which is reciprocated along its longitudinal axis, the heald rod having a resiliently deflectable body portion formed from a magnetically attractable material, a retention latch formation on the body portion, the retention latch formation during reciprocation of the heald rod being moved along a path of travel between first and second limits of reciprocal movement, said path of travel having a first zone of movement wherein the body portion travels in an undeflected position and a second zone of movement wherein the body portion travels in a deflected position, permanent magnetic means operable on the body portion during reciprocable movement of the heald rod to cause the body portion to move from the non-deflected position to the deflected position, fixed latch means located to one side of the first zone of the path of travel and arranged to engage the latch formation on the body portion only when the body portion is in said deflected position, and an electromagnet located adjacent said path of travel so that the body portion is located in the vicinity of the electromagnet when in its deflected position, the electromagnet when energised being capable of holding the body portion in the deflected position as the latch formation moves from the second zone and into the first zone of travel and thereby cause the latch formation to engage the fixed latch means.

BRIEF DESCRIPTION OF THE DRAWINGS

Various aspects of the present invention are hereinafter described with reference to the accompanying drawings, in which.

DESCRIPTION OF THE PREFERRED EMBODIMENT

The type of heald rod retention system with which the present invention is concerned with is described in our European patents 0119787 and 0188074 (U.S. Pat. Nos. 4,593,723 and 4,667,704).

The disclosure of both of these patents is incorporated herein and reference should be made thereto for a greater understanding of the constructional details and operation of the heald rod retention devices. For the purposes of clarity only one heald rod is illustrated as being associated with each heald rod retention device.

Figure 10:
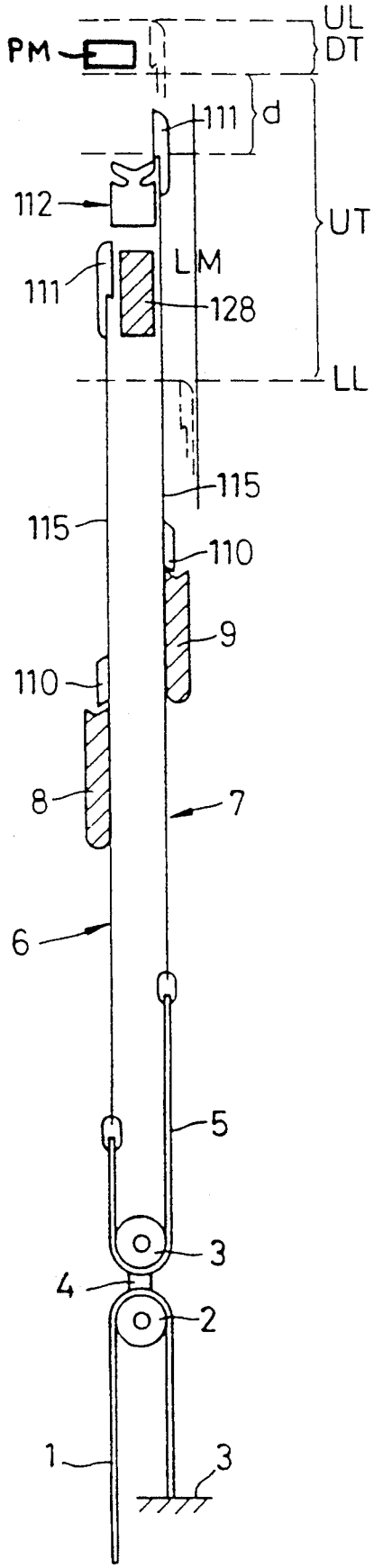
FIG. 10 is a diagrammatic representation illustrating the general principal of operation of a system according to the present invention

The method by which the healds are lifted is similar to that described in UK Patent No 2047755. For example, as shown in FIG. 10 healds (not shown) are attached to a lifting cord 1 which passes over a pulley wheel 2 to a fixing on the jacquard frame 3. Pulley 2 is attached to a second pulley wheel 3 via a housing 4 such that both wheels can rotate but are in fixed relationship to each other.

A second cord 5 which passes round wheel 3 connects two heald rods 6 and 7. These heald rods are raised and lowered alternately by knives 8 and 9 which press against knife hooks or abutments 110.

The heald rods include a resiliently deflectable body portion 115 formed from a magnetically attractable material on which is mounted a retention latch formation, preferably in the form of hook 111 which the heald control device causes to be either held or not by a fixed latch stop 112.

The sequence of operation of the hooks is described in Patent Nos UK 2047755 and EP 0119787 as are the knife drive means and the method of mounting and arranging the heald control devices.

The general principle of the operation of a system according to the present invention is described below with reference to FIG. 10.

Retention latches 111 are each reciprocated along a path of travel between a first or lower limit LL and a second or upper limit UL. This path of travel has a first zone UT wherein the latch travels with its heald rod body portion 115 in an undeflected state and a second zone DT wherein the latch travels with the body portion 115 in a deflected state under the influence of the permanent magnet PM.

Accordingly during each reciprocation of a heald rod, the latch travels from the lower limit LL along the first zone toward the upper limit UL and the body portion 115 remains in an undeflected state until the latch enters the second zone DT. When the latch enters the second zone DT on its upward stroke the body portion 115 is in a fully deflected state and is located in the vicinity of an electromagnet 128, ie the body portion contacts or is closely spaced from the pole(s) of the electromagnet 128.

On return of the latch from the upper limit UL towards the lower limit the body portion returns to its undeflected state as the latch exits the second zone and enters the first zone.

A fixed latch means 112 is located in the first zone and so in the absence of energisation of the electromagnet the latch passes by the fixed latch means 112 without engagement. The latch 112 is located by a distance d from the exit of the second zone which is sufficient to enable the body portion to return to its undeflected state before latch 111 encounters the fixed latch means 112.

If the electromagnet 128 is energised prior to the latch 111 leaving the second zone DT, the electromagnet 128 magnetically attracts the body portion 115 and holds it in its deflected state while the latch 111 travels across distance d. Accordingly, the latch 111 engages latch means 112 and arrests further movement of the latch 111 toward the lower limit LL.

In FIGS. 1 to 9 of the drawings, heald rod retention devices 10 are shown which include an elongate solenoid body 11 of the type shown in European patent 0188074.

The solenoid bodies 11 are spaced from one another by spacer members 12. Each solenoid body 11 and adjacent spacer member 12 define therebetween a guide passageway 15 along which a heald rod 16 reciprocates. Each body 11 includes a fixed latch means in the form of a latch hook 20.

Figure 1:
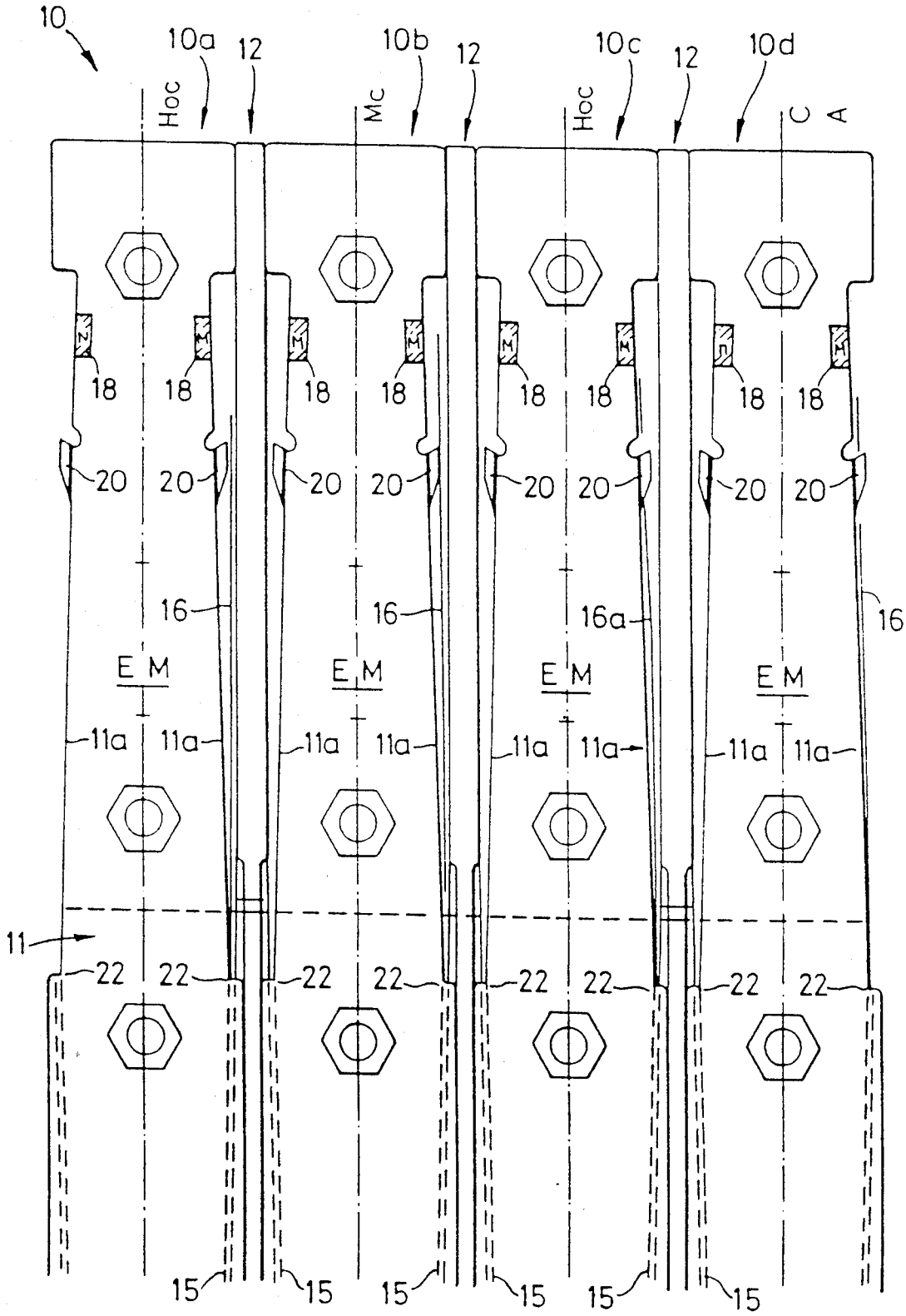
FIG. 1 is a schematic illustration showing a first embodiment of the present invention

In FIG. 1 the heald rod 16 is in the form of a metal strip such as, for example, that shown in European patent 0188074. The rod 16 is therefore preferably made from a spring steel strip and is capable of being magnetically attracted.

A permanent magnet 18, preferably a magnet formed from a ferrite material, is located on each side of the solenoid body. Each magnet 18 is positioned above the latch hook 20 preferably at a location which is adjacent to the upper limit of reciprocation of the terminal end of the heald rod 16. Such a position provides a maximum distance from the transition fulcrum point 22 about which the heald rod is deflected and thereby reduces to a minimum the force required for deflection of the rod.

In use, as the terminal end of the heald rod rises passed the associated latch hook 20 it remains in an undeflected state (this is illustrated in FIG. 1 with retention device 10*a* until it reaches close proximity to the associated permanent magnet 18 and thereby enters the magnetic field generated by the magnet 18. This position is illustrated in FIG. 1 with the retention device 10*b*. The heald rod as it continues to rise is then magnetically attracted toward the magnet 18 and is thereby deflected, bending about the transition fulcrum point 22 so that the upper portion 16*a* of the heald rod 16 thereafter lies in close proximity to the inclined side wall 11*a*. The condition is shown in FIG. 1 with the retention device 10*c*.

The heald rod, if it has not yet reached its upper limit of travel will continue to rise and then on reaching the upper limit of travel will then begin to fall. On its downward stroke, the terminal end of the heald rod is retained by the permanent magnet in contact with the side wall 11*a* until the terminal end passes over the magnet 18. At this point in its downward travel the terminal end of the heald rod is released by the permanent magnet and it returns under its inherent bias to its undeflected condition. In this condition the terminal end of the heald rod is free to continue its downward travel past the latch hook 20 without making contact therewith.

Each retention device 10 includes an electromagnet (not shown in FIG. 1) located in the region EM; the electromagnet having poles located adjacent side walls 11*a* for co-operation with the heald rod passing thereby. The electromagnet may be of the kind shown and described in our European patents 0119787 and 0188074.

If selection of the heald rod is required, then at some point during the loom cycle where the heald rod has been deflected by the permanent magnet, the electromagnet is activated. This has the effect of the electromagnet retaining the heald rod in a deflected condition after the upper end of the heald rod has passed by the permanent magnet during its downward stroke. Thus continued downward movement causes the latch at the upper end of the heald rod to contact engage the latch hook 20. This condition is illustrated in FIG. 1 with the retention device 10*d*. Thereafter the electromagnet can be de-energised.

Since the electromagnet does not have to generate a sufficiently large magnetic field to cause deflection of the heald rod from its normal path of travel, the power requirement for the electromagnet can be considerably reduced. As seen with the retention device 10*b* the heald rod bows slightly away from side wall 11*a*. The electromagnet is chosen to be of sufficient power to magnetically attract this portion of the heald rod.

It is envisaged that various modifications may be adopted to achieve the same function of causing the heald rod to be deflected by a permanent magnet. In FIGS. 2 to 6 similar parts have been designated by the same reference numerals.

Figure 2:
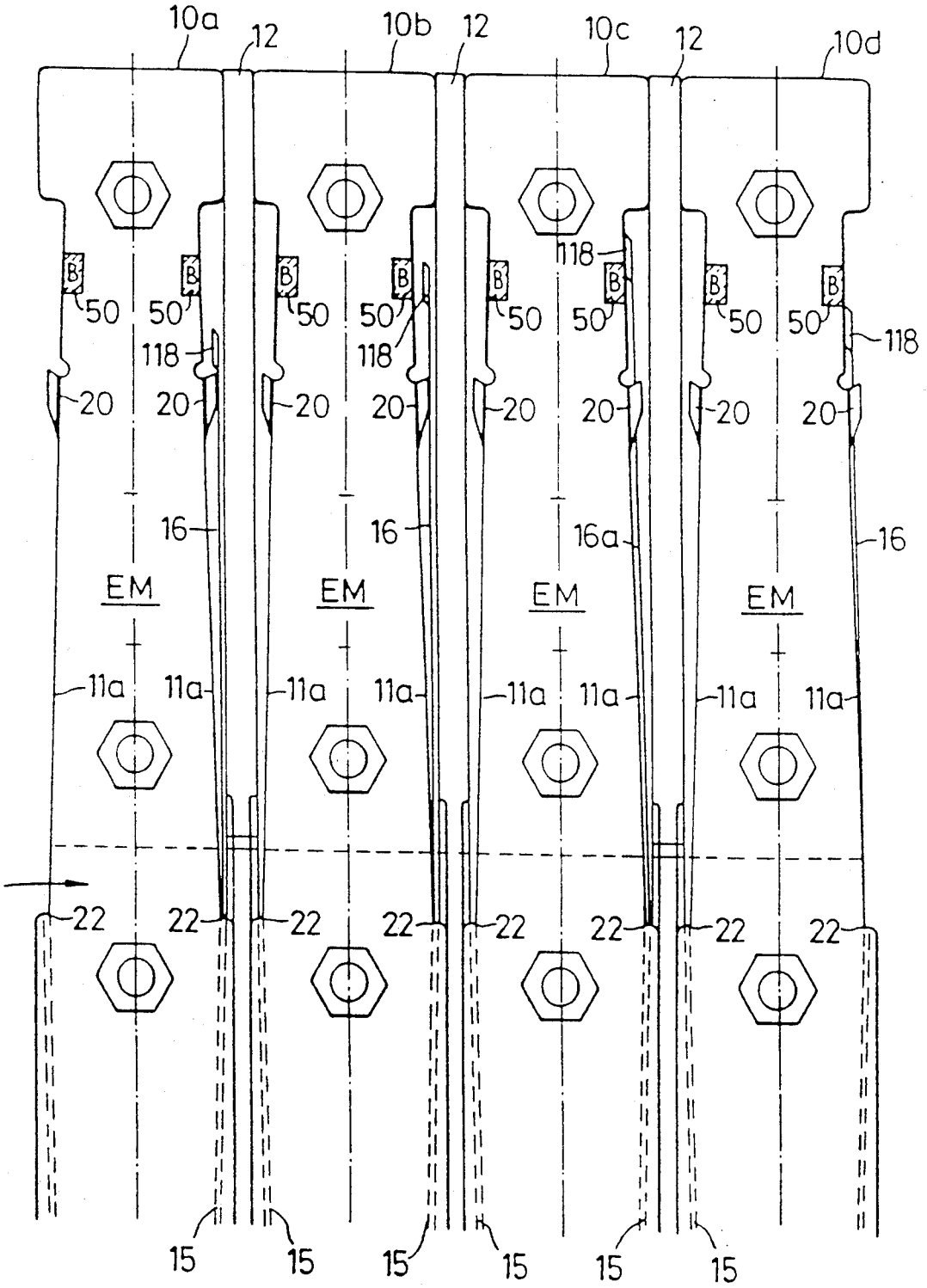
FIG. 2 is a schematic illustration showing a second embodiment according to the present invention

In this respect, in FIG. 2, a permanent magnet 118 is attached to the terminal end of the heald rod 16 and an insert 50 of a magnetic material such as steel is mounted on each side of the solenoid body 11. Thus as the heald rod rises and comes into close proximity with the insert 50 it is magnetically attracted thereto to cause deflection of the heald rod. This sequence is illustrated in FIG. 2 with devices 10*a*, 10*b* and 10*c*. After deflection, the electromagnet is energised as its the embodiment of FIG. 1 to cause engagement of the heald rod with the latch hook 20. This condition is illustrated in FIG. 2 with retention device 10*d*.

Figure 3:
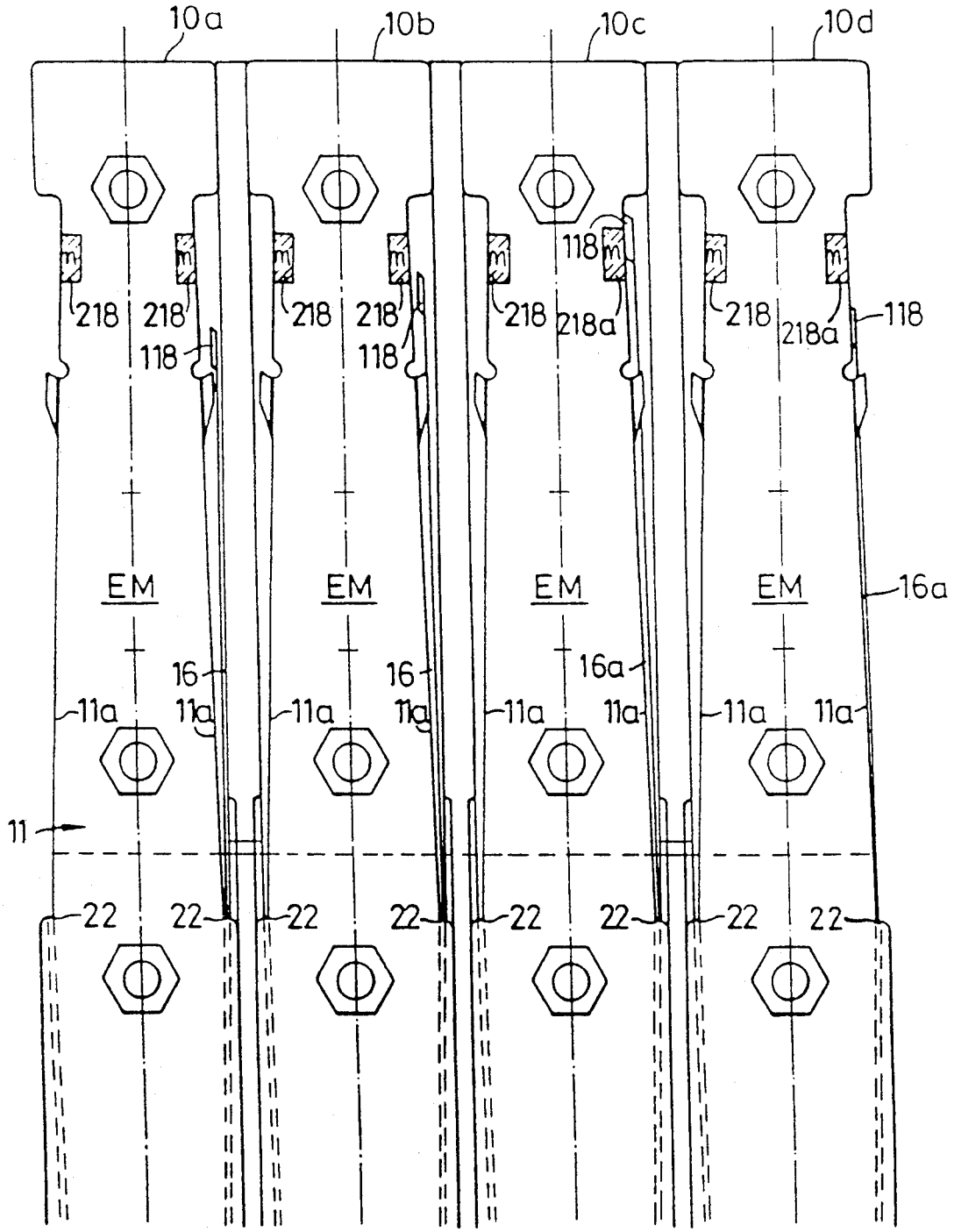
FIG. 3 is a schematic illustration showing a third embodiment according to the present invention

In the embodiment illustrated in FIG. 3, the heald rods 16 are again provided with a permanent magnet 118 in a similar manner to that for the embodiment of FIG. 2 but the insert 50 is replaced by a second permanent magnet 218. Co-operating magnets 118 and 218 have either single poles on their opposed faces as illustrated in FIG. 4 or can be provided with opposite poles on each face as shown in FIG. 5.

Figure 4:
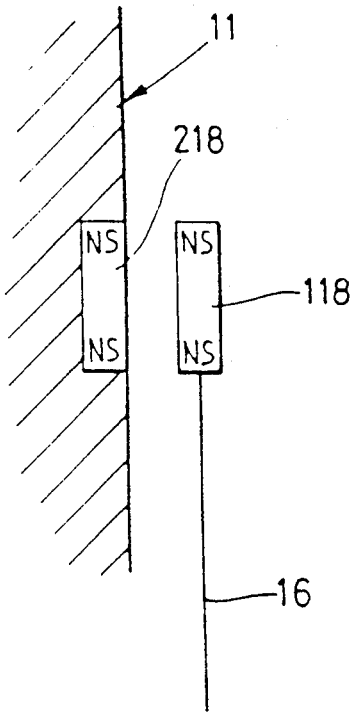
FIG. 4 is a schematic illustration showing a first permanent magnet arrangement for incorporation into the embodiment shown in FIG. 3

The arrangement of FIG. 4 enables a higher magnetic force of attraction to be generated than in embodiments of FIGS. 1 and 2 and hence enables a more rapid deflection to be achieved.

In the arrangement of FIGS. 1, 3 and 4 wherein a permanent magnet is located on opposite sides of the solenoid body 11, it is envisaged that a single permanent magnet may be provided extending laterally through the body 11 to emerge at opposite sides of the body 11 to provide a permanent magnetic pole for attracting a heald rod. The permanent magnets are preferably arranged such that the facing magnetic poles on adjacent solenoid bodies are of opposite polarity.

Figure 5:
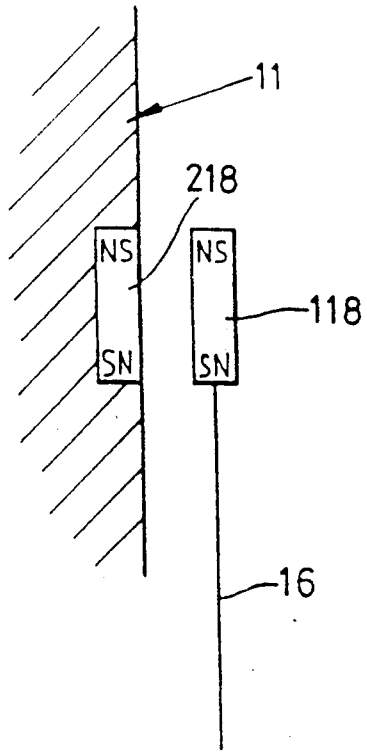
FIG. 5 is a schematic illustration showing a second permanent magnet arrangement for incorporation into the embodiment shown in FIG. 3

The arrangement of FIG. 5 enables the same degree of magnetic force to be generated as for the arrangement of FIG. 4 but also provides a more precise location in the path of travel of the heald rod at which inward deflection occurs on the upward stroke of the heald rod. In addition as the heald rod descends during its downward stroke, when the like poles of the opposed magnets 118,218 are in proximity to one another, a positive force, generated by magnetic repulsion of like poles, supplements the inherent bias of the heald rod for returning the heald rod to its undeflected condition. This arrangement thus helps to ensure that undesired selection of a heald rod is avoided.

Figure 6:
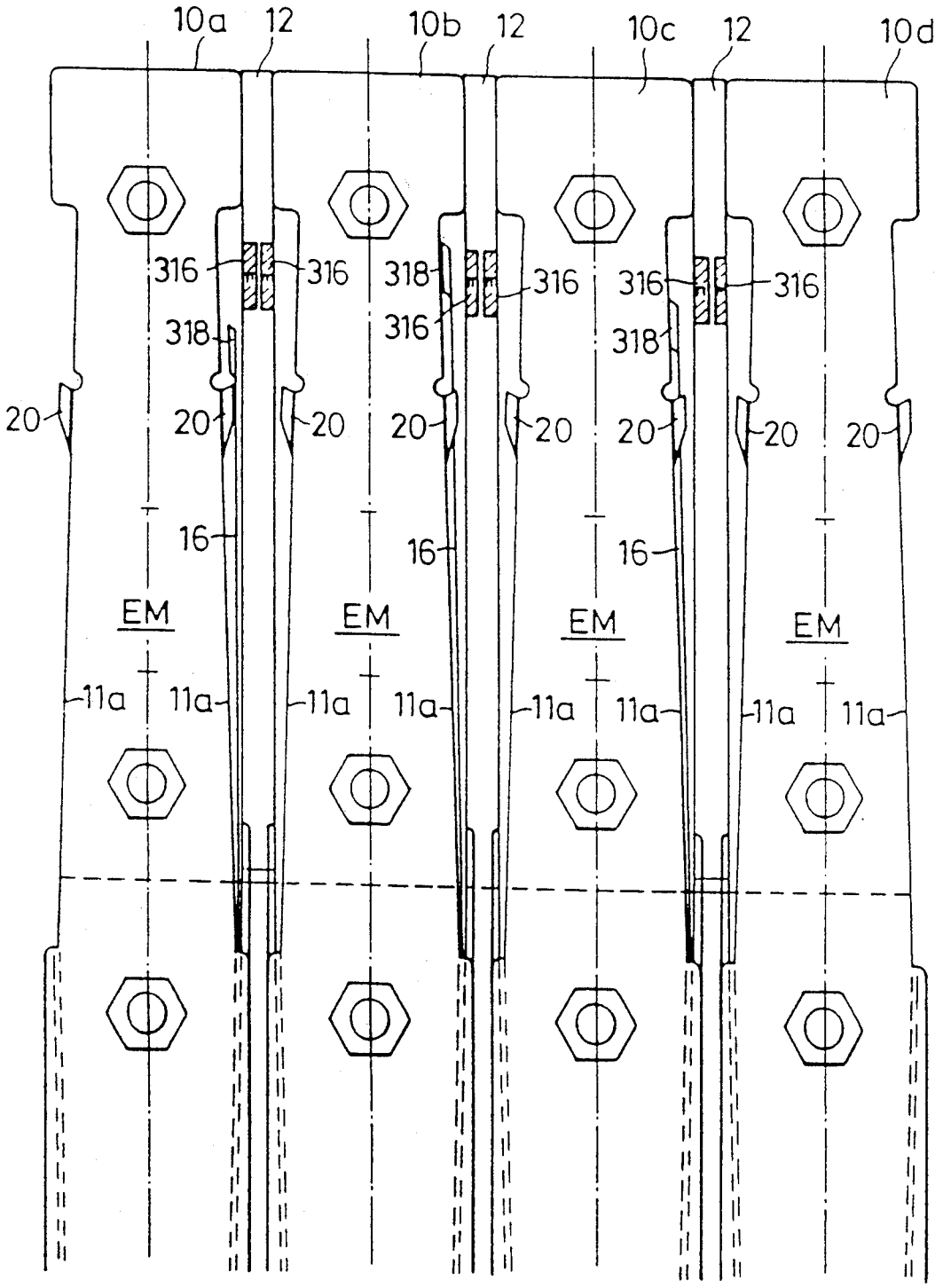
FIG. 6 is a schematic illustration showing a fourth embodiment according to the present invention

In the embodiment illustrated in FIG. 6 a permanent magnet 318 is provided on the terminal end of the heald rod 16 and a permanent magnet 316 is located on the adjacent spacer member 12 for co-operation with the magnet 318 to cause the heald rod 16 to deflect by magnetic repulsion between magnets 316,318. This deflected condition of the heald rod is shown with device 10*b* and its latched condition is shown with 10*c*. This arrangement has an advantage in that it enables a rapid deflection to occur at a fairly precise location during travel of the heald rod. This is due to the co-operating magnets 316,318 initially being close together prior to repulsion and thus a large separating force is initially applied to the magnets.

The poles of magnets 316,318 may be arranged in a similar manner to that shown in FIGS. 4 or 5.

Figure 7:
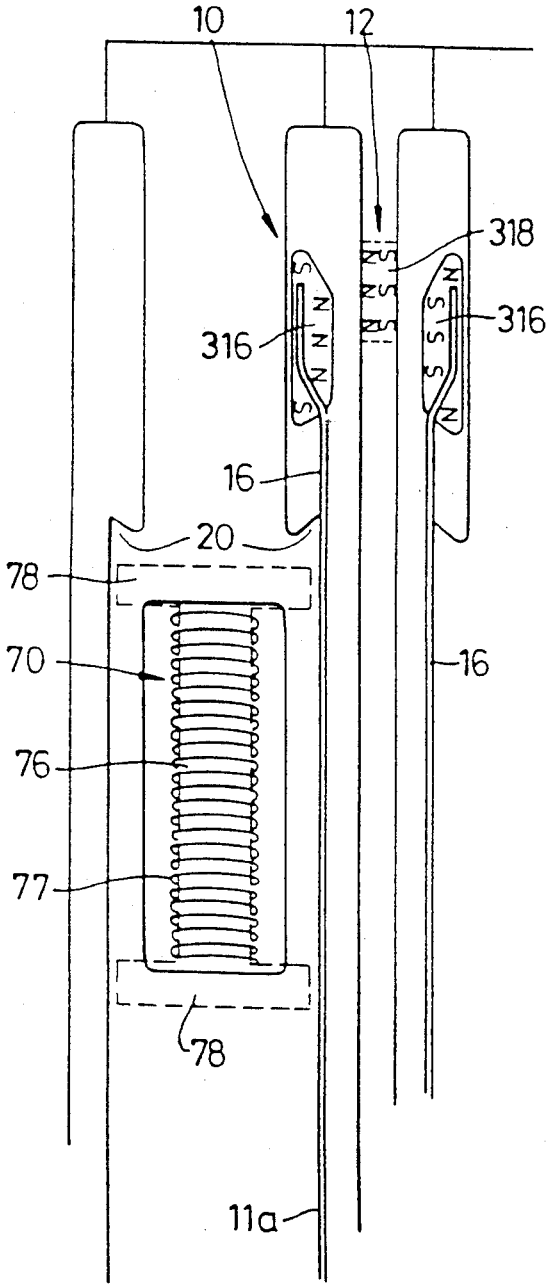
FIG. 7 is a more detailed view of a fifth embodiment according to the present invention

In FIG. 7 a further embodiment is illustrated which operates in a similar manner to the embodiment of FIG. 6.

In FIG. 7 the retention device is shown as having an electromagnet 10 which includes a soft iron or steel core 76 around which there are electrical windings 77. When a current is passed through the winding, lugs 78 at end of the core become the north and south poles. The faces of these lugs are flush with the side wall 11*a*. This type of electromagnet may be incorporated in all the embodiments described herein.

Conveniently the permanent magnets provided on the heald rods are preferably formed by moulding a suitable plastics material filled with a magnetisable material. An example of a suitable heald rod is illustrated in FIGS. 8 and 9.

Figure 8:
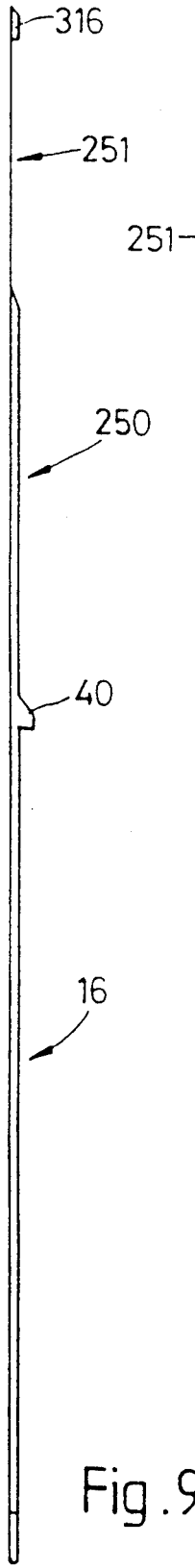
FIG. 8 is a front view of a heald rod according to the present invention
Figure 9:
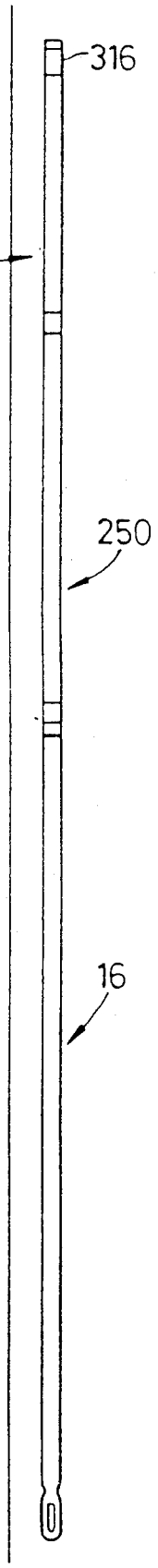
FIG. 9 is a side view of the heald rod shown in FIG. 8

The heald rods 16 illustrated in FIGS. 8 and 9 have an elongate body 250 formed from a plastics material. The upper end portion 251 of the heald rod is formed by a resilient magnetic metal strip which at one end is embedded in the one end of the elongate body 250 and which at its opposite end carries the permanent magnet 316 which also defines a catch for engagement with the latch 20. Accordingly each heald rod 16 is conveniently formed by injection moulding. The knife hook 40 for engaging the knives of the loom is formed integrally with the body 250.

The length of the metal strip of end portion 251 is chosen to provide a desired low resistance to bending and in addition the thickness and width of the metal strip are also chosen to provide the desired low resistance to bending. In this way the electromagnet can be of low power consumption for maintaining the heald rod in a deflected condition.

In the embodiment illustrated in FIGS. 7 and 8 the metal strip has a thickness of about 0.35 mm and a width of 4 mm.

The heald rods shown in FIGS. 8 and 9 are suitable for use in any of the embodiments described herein. If used in the embodiment of FIG. 1, the plastics moulding formed at the end of the metal strip would be arranged to either enable the metal strip itself to be attracted to the magnet 18 and/or the plastics material can be filled with a magnetic material thereby enabling the moulding itself to be attracted to the magnet 18.

In the embodiments shown in FIGS. 1 to 6, the retention latch formation on the heald rod is defined by an aperture which is formed in the heald rod for engagement with the latch 20 in a similar manner to that described in our European patent 0188074.

When heald rods of the type shown in FIGS. 8 and 9 define a retention latch formation in the form of a hook, the plastics moulding of the end of the strip would be used for engaging the latch 20 thereby avoiding the need to provide a latch engaging aperture in the heald rod

We claim:

1. A heald control system including a heald rod which is reciprocated along its longitudinal axis, the heald rod having a resiliently deflectable body portion formed from a magnetically attractable material, a retention latch formation on the body portion, the retention latch formation during reciprocation of the heald rod being moved along a path of travel between first and second limits of reciprocal movement, said path of travel having a first zone of movement in said path wherein the body portion normally travels in an undeflected position, and a second zone of movement in said path wherein the body portion travels in a deflected position, permanent magnetic means operable on the body portion during reciprocal movement of the heald rod to cause the body portion to move from the undeflected position to the deflected position as the latch formation travels from the first zone into the second zone, fixed latch means located to one side of the first zone of the path of travel to engage the latch formation on the body portion only when the body portion is in said deflected position, and an electromagnet located adjacent said path of travel so that the body portion is located in the vicinity of the electromagnet when in its deflected position, the electromagnet when energised holding the body portion in the deflected position as the latch formation moves from the second zone into the first zone of travel, thereby causing the latch formation to engage the fixed latch means.

2. A system according to claim 1 wherein the permanent magnetic means is polarized to cause the body portion to move to its deflected position by magnetic attraction.

3. A system according to claim 1 wherein, the fixed latch means and the electromagnet are mounted in an elongate body, the permanent magnetic means including a permanent magnet mounted in the elongate body for magnetically attracting said body portion.

4. A system according to claim 3 wherein said permanent magnet means comprises a permanent magnet mounted on the body portion and a permanent magnet mounted in the elongate body for causing movement of the body portion to its deflected position.

5. A system according to claim 1 wherein the fixed latch means and the electromagnet are mounted in an elongate body, and the permanent magnetic means comprises a permanent magnet mounted on the body portion and an element of magnetic material mounted on the elongate body for cooperation with said permanent magnet.

6. A system according to claim 1 wherein the permanent magnetic means comprises a pair of permanent magnets having a polarity to cause the body portion to move to its deflected position by magnetic repulsion.

7. A system according to claim 6 wherein the permanent magnetic means includes a permanent magent counted on the body portion and a permanent magent mounted adjacent the path of reciprocal movement on the side of said path opposite to the fixed latch means.

8. A system according to claim 1 where the permanent magnet means comprises a permanent magnet mounted on the body portion in the form of a plastics moulding including magnetized material.

9. A system according to claim 8 wherein said plastics moulding includes said retention latch formation.

10. A system according to claim 1 wherein, the body portion is formed from a strip of resilient metal.

* * * * *

UNITED STATES PATENT AND TRADEMARK OFFICE

CERTIFICATE OF CORRECTION

PATENT NO. : 5,176,186

DATED : January 5, 1993

INVENTOR(S) : Alan Bousfield, et al

It is certified that error appears in the above-indentified patent and that said Letters Patent is hereby corrected as shown below:

On the title page, In the Abstract:

Line 12, after "magnet" delete "means";

Column 2, line 55, after "latch" insert --means in the form of a--;
Column 8, line 2, "magent" should be --magnet--;
Column 8, line 3, "magent" should be --magnet--;

Signed and Sealed this

Second Day of November, 1993

Bruce Lehman

*Attest:*

BRUCE LEHMAN

*Attesting Officer*

*Commissioner of Patents and Trademarks*